US006729895B1

(12) United States Patent
Bryan

(10) Patent No.: US 6,729,895 B1
(45) Date of Patent: May 4, 2004

(54) ELECTRICAL CONNECTOR

(76) Inventor: Clyde W. Bryan, 10802 Pepper La., Houston, TX (US) 77079

( * ) Notice: Subject to any disclaimer, the term of this patent is extended or adjusted under 35 U.S.C. 154(b) by 0 days.

(21) Appl. No.: 10/172,819

(22) Filed: Jun. 17, 2002

(51) Int. Cl.[7] ..... H01R 13/15
(52) U.S. Cl. ..... 439/263
(58) Field of Search ..... 439/263, 264, 439/259

(56) References Cited

U.S. PATENT DOCUMENTS

| | | | | |
|---|---|---|---|---|
| 3,950,056 | A | 4/1976 | Bowen | |
| 4,138,181 | A | 2/1979 | Hacker et al. | |
| 4,589,721 | A | 5/1986 | Sedig et al. | |
| 4,687,273 | A | 8/1987 | Pranch | |
| 5,033,982 | A | 7/1991 | Lucas | |
| 5,366,392 | A | 11/1994 | Raloff et al. | |
| 6,152,751 | A * | 11/2000 | Hanson et al. | 439/263 |

* cited by examiner

*Primary Examiner*—Gary Paumen
(74) *Attorney, Agent, or Firm*—Kenneth H. Johnson

(57) ABSTRACT

An electrical connector comprising a body having at least two channels to receive a conducting electrical cable, a conducting inner compression locking sleeve positioned in each channel, preferably slotted to allow it to close about and grasp the cable, in electrical contact with an outer compression locking sleeve positioned slidably along each of said inner compression locking sleeve. A tab extends from the outer compression locking sleeve through a slot in the body to allow the outer compression locking sleeve to be moved by hand along the inner compression locking sleeve. The outer sleeve is preferably non conducting, thus allowing the tab to be formed as an integral part thereof. The inner sleeve has a larger diameter than the outer sleeve and to facilitate sliding the outer sleeve over the inner sleeve, such as a generally frustoconical cross section with the base portion having the largest diameter being distal from the outer sleeve in the open position. Sliding the outer sleeve along the inner sleeve toward the larger base will squeeze the larger base close about the cable.

8 Claims, 2 Drawing Sheets

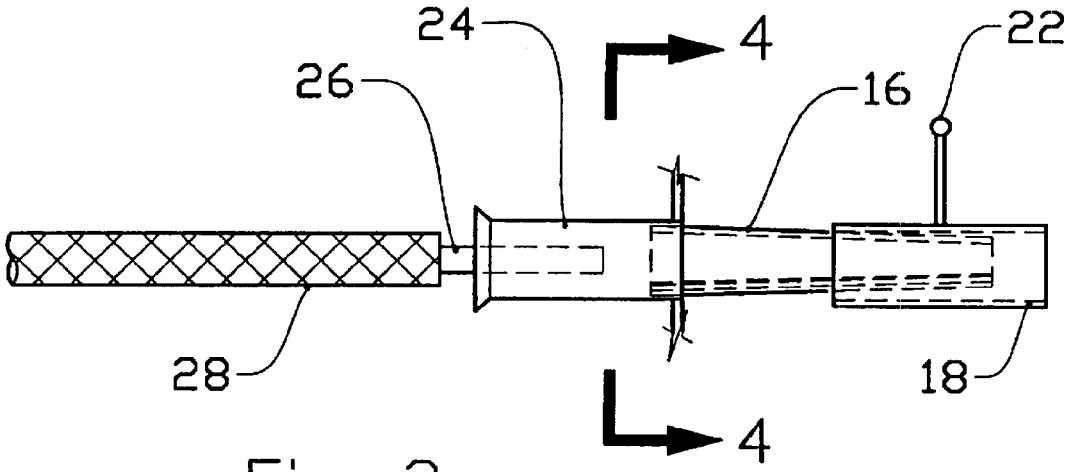
Fig. 3
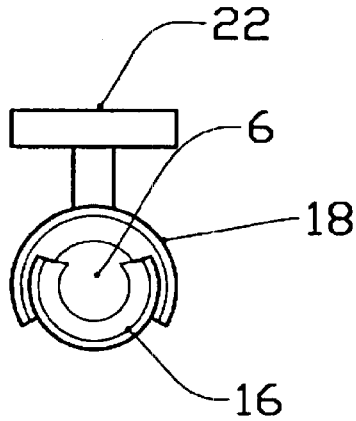
Fig. 4
Fig. 5
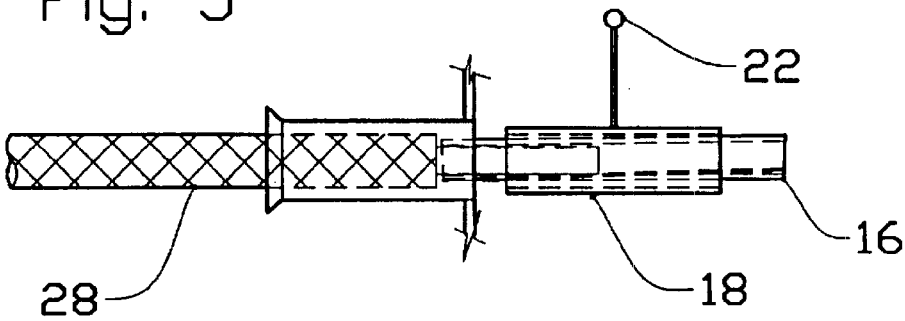

ELECTRICAL CONNECTOR

BACKGROUND OF THE INVENTION

1. Field of the Invention

The present invention relates to connectors for electrical conductors. More particularly it relates to a novel quick connect electrical cable connector, for single or multiple conductor systems.

2. Related Art

Many different types of releasable electrical cable in-line single connectors are available where a male and female component are connected, such as U.S. Pat. Nos. 5,366,392; 4,589,721 and 4,138,181. A releasable multiple connector is disclosed in U.S. Pat. No. 3,950,056.

It is an advantage of the present invention that it provides a simple device with few components, which is easily used to releasably connect electrical cable. It is a further advantage that the present connector may be in used in place of wire nuts for connecting two or more wires.

SUMMARY OF THE INVENTION

Briefly the present invention is an electrical connector comprising a body having at least two channels therein defining a space to receive a conducting electrical cable therein, a conducting inner compression locking sleeve positioned in each channel in electrical contact with a separate outer compression locking sleeve positioned slidably along each said inner compression locking sleeve. Preferably a tab extends from the outer compression locking sleeve through a slot in the body to allow the outer compression locking sleeve to be moved by hand along the inner compression locking sleeve.

Preferably the inner sleeve is a resilient material, such a metal spring which will be compressed about the cable (bare wire) to form a good electrical contact and which will return to is original form when the outer sleeve is withdrawn from the inner sleeve allowing the cable to be removed. Also the inner sleeve is slotted to allow it to close about and grasp the cable without crimping.

The outer sleeve is preferably non conducting, thus allowing the tab to be formed as an integral part thereof. Also the slot in the body is effectively closed by the outer sleeve and a non conductive material would prevent inadvertent contact with conducting components inside the body. To achieve the closure of the inner sleeve, it preferably has a larger diameter than the outer sleeve and to facilitate sliding the outer sleeve over the inner sleeve, the inner sleeve may have a generally frustoconical cross section with the base portion having the largest diameter being distal from the outer sleeve in the open position. Sliding the outer sleeve along the inner sleeve toward the larger base will squeeze the larger base close about the cable.

In one embodiment the present connector has a non releasable cable channel which is electrically connected to two or more releasable channels.

BRIEF DESCRIPTION OF THE DRAWINGS

FIG. 3 is an isolate detail cross sectional view of the locking mechanism of the present connector in the open position.

FIG. 4 is a cross sectional view along line 4—4 of FIG. 3.

FIG. 5 is an isolate detail cross sectional view of the locking mechanism of FIG. 3 in the closed position.

DETAILED DESCRIPTION

Figure 1:
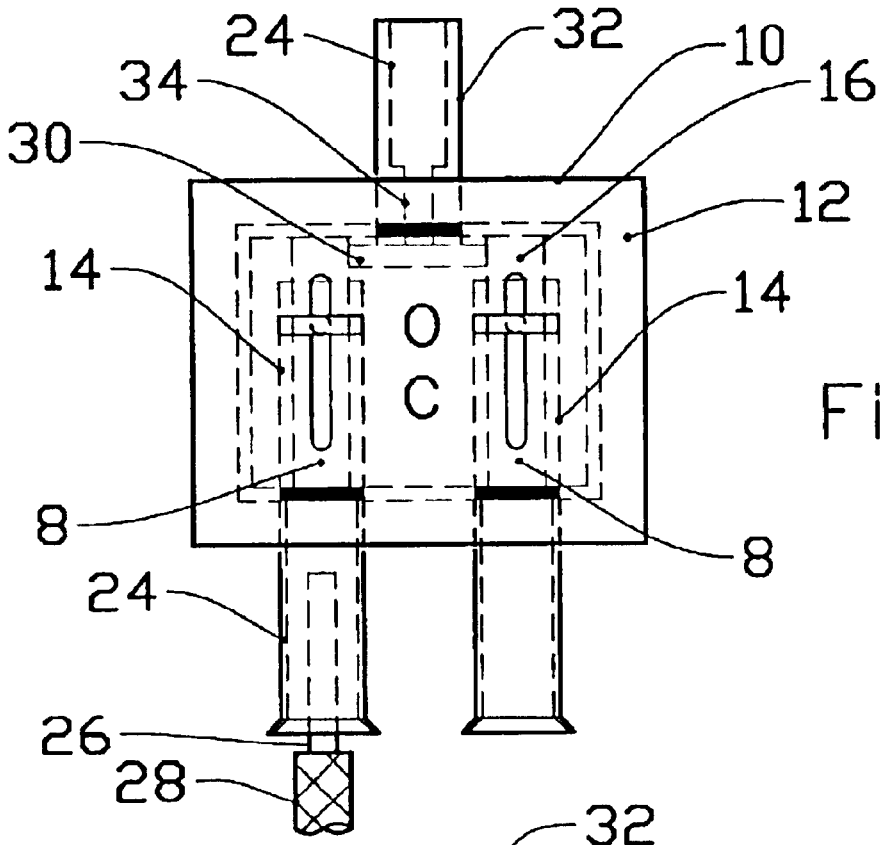
FIG. 1 is a top inplan view of one embodiment of the present connector.
Figure 2:
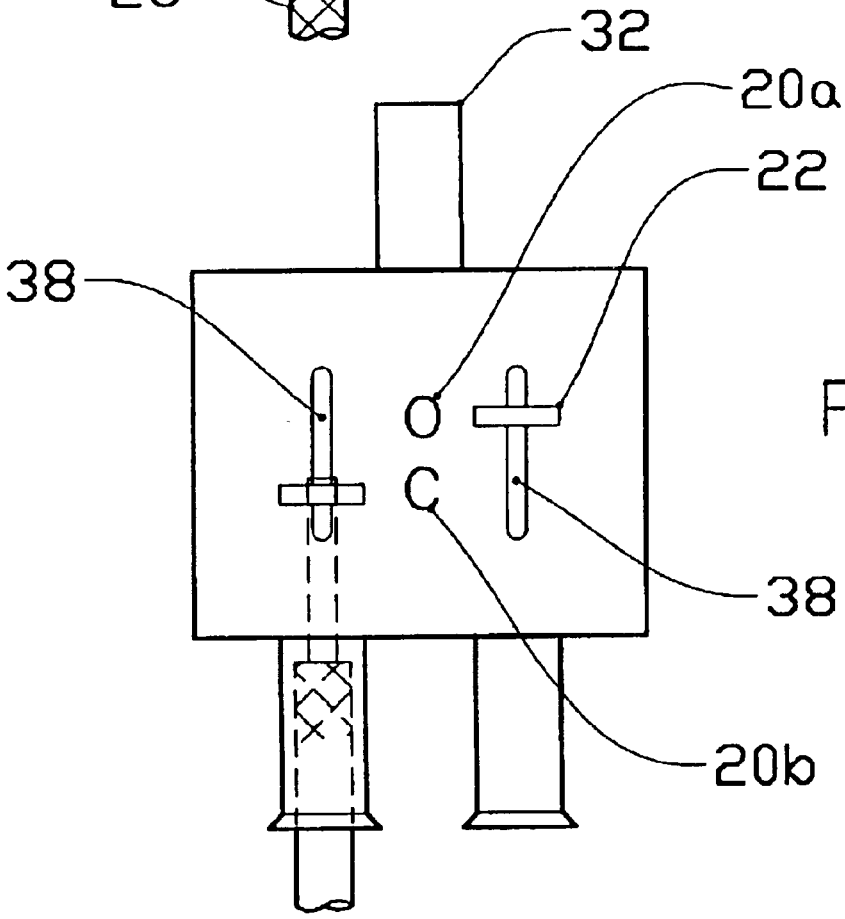
FIG. 2 is a top view of the embodiment of FIG. 1.

Referring to FIG. 1 a connector 10 is shown having a body 12 with two releasable ports 8 for inserting wire 28. Each releasable port 8 has a channel 14 in which a inner sleeve 16 is positioned and in electrical contact with the other channel vial electrical bus 30. Electrical bus 30 is also in electrical contact with the optional fixed cable port 32 through electrical conduit 34 to which a bare wire (not shown) is contacted. If more ports are present they may also be in electrical connection with all other ports. In some embodiments a body may contain more than one separate set of inter connected ports. Each port has an insulation sleeve 24, through the insulated wire 28 is inserted and seated while the exposed wire 26 engages in electrical contact in the body. An outer sleeve 18 is positioned on each inner sleeve 16 and slidable over and along the inner sleeve. A tab 22 attached to the outer sleeve extends through lock slot 38, which allows the releasable ports to be closed and opened by hand.

In FIG. 1 each of the releasable slots are shown in the "open position", which more clearly seen in FIG. 3. The inner sleeve is a conductive material and preferably has an elongated configuration that at provides a guide for the outer sleeve as it slides in the direction of the arrow in FIG. 3 and a section which has either the same or large diameter than the outer sleeve. A frustoconical cross section conveniently achieves both functions for the inner sleeve, preferably with a slot 6 extending at least that portion of the inner sleeve to be compressed about the bare wire, wherein the inner sleeve 16 has a generally frustoconical cross section with a base portion having the largest diameter of the frustoconical cross section, the base being distal from the outer sleeve 18 in an open position as shown in FIG. 3. As shown in FIG. 5, in the closed position the end of the inner sleeve 16 which is shown FIG. 3 as the largest end remains distal from the outer sleeve 18, but is compressed about wire 26. In this embodiment the inner sleeve is a spring metal which is compress as the outer sleeve sides along it and comes to a stop at the point shown in FIG. 5, i.e., the "closed position". The compressed inner sleeve against the bare wire and the spring bias against the outer sleeve, holds the outer sleeve securely in place, but can be released by appropriate pressure against the tab 22 in the direction opposite to the arrow.

What is claimed is:

1. An electrical connector comprising a body having at least two channels therein defining a space to receive a conducting electrical cable therein, a conducting inner compression locking sleeve positioned in each channel in contact with a separate outer compression locking sleeve positioned slidably along each said inner compression locking sleeve and a tab extends from the outer compression locking sleeve through a slot in the body.

2. The electrical connector according to claim 1 wherein the inner sleeve comprises a resilient material.

3. The electrical connector according to claim 1 wherein the inner sleeve is slotted.

4. The electrical connector according to claim 1 wherein the outer sleeve is non conducting.

5. The electrical connector according to claim 1 wherein the inner sleeve has a base portion distal to said outer sleeve and a generally frustoconical cross section, said base portion being a largest diameter of said frustoconical cross section.

6. The electrical connector according to claim 1 comprising a cable channel for receiving and seating a wire therein which is electrically connected to two or more said channels.

7. The electrical connector according to claim 1 wherein said channels are electrically connected.

8. The electrical connector according to claim 1 wherein the outer sleeve is conducting.

* * * * *